US011607035B1

(12) United States Patent
Riner et al.

(10) Patent No.: US 11,607,035 B1
(45) Date of Patent: Mar. 21, 2023

(54) TRAY SYSTEM

(71) Applicant: Group Dekko, Inc., Fort Wayne, IN (US)

(72) Inventors: Raymond H. Riner, Fort Wayne, IN (US); Austin S. Valley, Grand Rapids, MI (US)

(73) Assignee: Group Dekko, Inc., Fort Wayne, IN (US)

( * ) Notice: Subject to any disclaimer, the term of this patent is extended or adjusted under 35 U.S.C. 154(b) by 0 days.

(21) Appl. No.: 17/508,126

(22) Filed: Oct. 22, 2021

(51) Int. Cl.
*A47B 13/02* (2006.01)
*A47B 3/06* (2006.01)
*A47B 13/00* (2006.01)

(52) U.S. Cl.
CPC ..... *A47B 13/023* (2013.01); *A47B 3/06* (2013.01); *A47B 13/003* (2013.01)

(58) Field of Classification Search
CPC ..... A47B 13/023; A47B 13/003; A47B 2013/024
See application file for complete search history.

(56) References Cited

U.S. PATENT DOCUMENTS 6,484,649 B1 * 11/2002 Wang ..... A47B 13/023 108/150
10,213,041 B1 * 2/2019 Fonseca ..... F21V 23/002
2008/0054141 A1 * 3/2008 Koehler ..... A47B 96/06 248/218.4
2018/0000241 A1 * 1/2018 Wei ..... A45B 25/02
2019/0335893 A1 * 11/2019 Erickson ..... A47B 37/04
2021/0401165 A1 * 12/2021 Zhenni ..... A47B 37/04

* cited by examiner

*Primary Examiner* — Daniel J Rohrhoff
(74) *Attorney, Agent, or Firm* — Taylor IP, P.C.

(57) ABSTRACT

A tray system including a column, a tray and a tray collar. The tray has an opening through which the column extends. The tray collar is constrained against the column, the tray being a part of or resting upon the tray collar.

15 Claims, 5 Drawing Sheets

TRAY SYSTEM

BACKGROUND OF THE INVENTION

1. Field of the Invention

The present invention relates to a stand holding a tray, with the tray being constrained to the stand.

2. Description of the Related Art

Tables and trays exist in the earliest records of mankind. Elevated flat surfaces that provide a natural utility to the user are needed for a variety of purposes and as such have developed into numerously varied items. For example, desks, nightstands, chests of drawers, counter tops, end tables, TV trays, to name a few, all have flat upper surfaces.

A pedestal table has a central support that supports a table surface. A Loo table is a table developed in the $18^{th}$ century that typically had an oval or round top and a hinge mechanism affixed to the pedestal base, allowing the tabletop to be hinged over for easy storage, or for the display of artwork that may be embedded in the surface of the tabletop.

In public areas, such as parks, a pedestal table can be provided having a single column support that is embedded in the ground, or in a suitable ballast to prevent movement, with a tabletop mounted to the top of the single column. A movable version is often used in reception areas in the form of small tabletops arranged at a height that allow easy use for the setting of drinks or food thereon, while people stand therearound, allowing people to congregate around for collaboration and socialization.

In each case the tables lack integrated electrical and charging circuits to power devices in common use today. Additionally, the adjustability of the surface is limited.

What is needed in the art is a cost-effective table/tray system that allows for adjustability and delivery of power.

SUMMARY OF THE INVENTION

The present invention provides a table tower with an adjustable tray.

The invention in one form is directed to a tray system including a column, a tray and a tray collar. The tray has an opening through which the column extends. The tray collar is constrained against the column, the tray being a part of or resting upon the tray collar.

The invention in another form is directed to a tray system including a column, a base, a tray and a tray collar. The base is coupled to an end of the column. The tray has an opening through which the column extends. The tray collar has a plurality of portions that are contactable to an outer surface of the column, the portions being constrained against the column. The tray rests upon the tray collar.

The invention in yet another form is directed to a method for supporting a tray, the method including the steps of extending, contacting and securing. The extending step extending a column through an opening in the tray. The contacting step contacting an outer surface of the column with a first portion and a second portion of a tray collar. The securing step securing the first portion to the second portion against the outer surface of the column.

An advantage of the present invention is that the tray is adjustable along the column.

Another advantage of the present invention is that the tray collar is fully adjustable along the length of the column, being two identical pieces that are combined.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
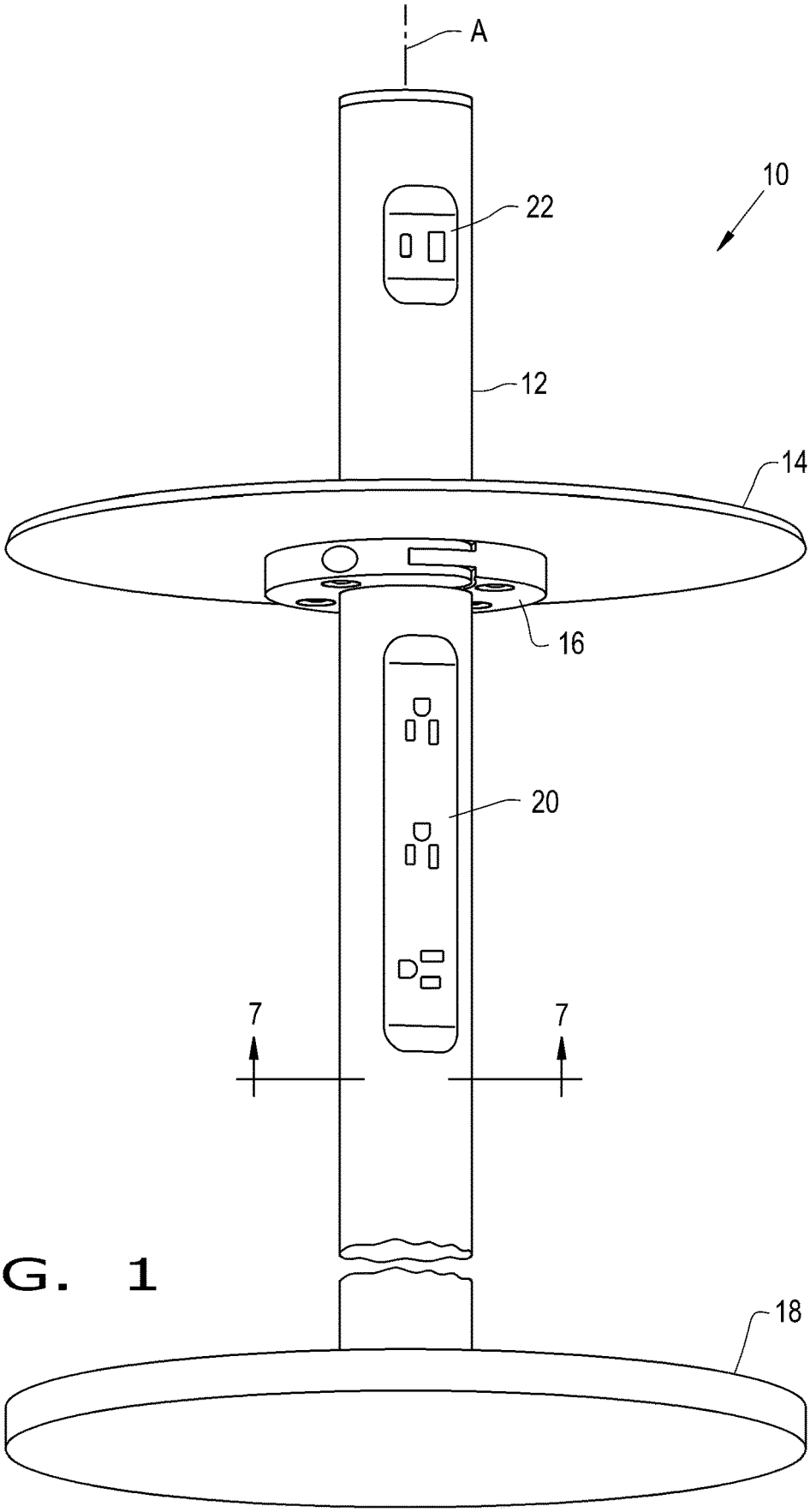
FIG. 1 is a perspective view of an embodiment of a tray system having a tray collar, of the present invention, coupled to a tower with the tray collar holding the tray in position.
Figure 2:
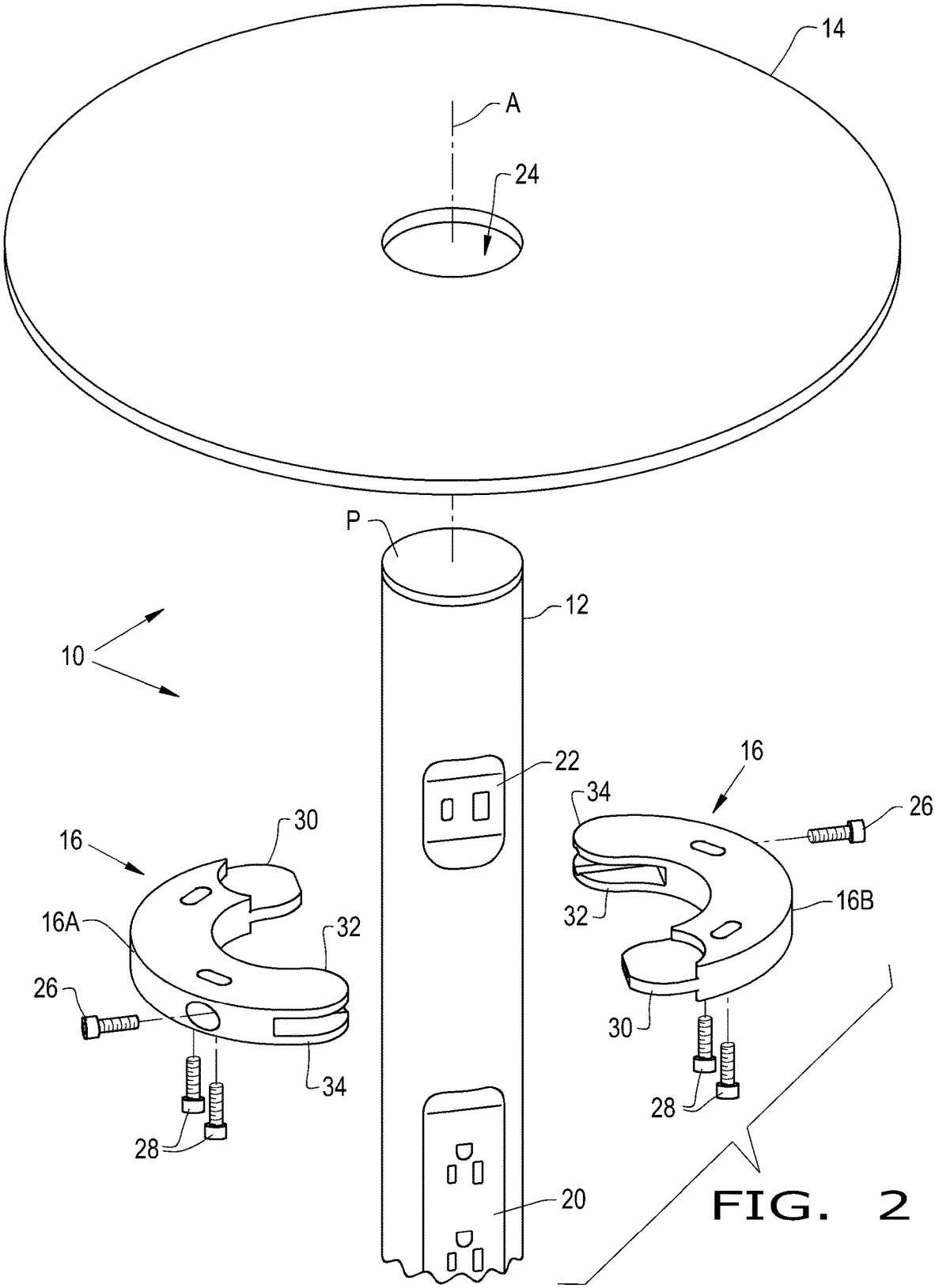
FIG. 2 is a perspective exploded view illustrating the tray collar and the tray exploded from the tower of FIG. 1.

Referring now to the drawings, and more particularly to FIGS. 1 and 2, there is shown an embodiment of a tower tray system 10 including a tower column 12, a tray 14, a tray collar 16, a base 18, a set of outlets 20, and an outlet 22. Tray collar 16 can also be referred to as a tray clamp 16. Tray column 12 may be a cylindrical tube having electrical and data connections presented along the sides that are connected to electrical conductors that run therein. Tray 14 is illustrated as a disk-shaped tray 14, although other shapes are also contemplated. Tray 14 has an opening 24 though which column 12 extends.

Base 18 is arranged to set on a horizontal surface and provides support to column 12. Base 18 is formed to allow an electrical power cord to extend therefrom and have an opening through which electrical wiring can extend into column 12. Column 12 is depicted as a cylindrical tube, although other shapes are contemplated. Column 12 provides a wiring chase through which internal wiring is provided for the powering of outlets 20 and charging circuits that may be made available at outlets 22. Slots are cut or formed along sides of column 12 to allow power fixtures such as outlets 20 and 22 that are presented to, and are available for, use by the user of tower tray system 10. Outlets 20 and 22 are presented on both sides of column 12, even though only one side is illustrated.

Outlets 20 and 22 have cover plates that conform with edges in the slots in column 12, so that edges of that slot are covered. The ends of the cover plates extend along the curve created by the curved ends of the slot, as seen in in FIG. 1, and the curve of the surface of column 12. The placing of outlets 20 and 22 along surfaces of column 12 are a mater of choice and can be at various positions along the length of column 12. A top plate P can be inserted at the top of column 12 to provide a finished look, and top plate P can be removed to provide access to the interior of column 12.

Tray collar 16 is constrained against column 12, with collar 16 being under tension, hence compressing collar 16 against column 12 to thereby prevent the movement of collar 16 relative to column 12. This allows tray 14 to rest upon tray collar 16. Tray 14 can be fastened to collar 16 by using fasteners such as screws 28.

Tray collar 16 is made up of portions 16A and 16B that interact so that together they contact an outer surface of column 12. Collar portions 16A and 16B are identical having an arcuate shape and ears 30, 32 and 34 with ear 30 being on one end of the arcuate shape and ears 32 and 34 being on the other end of the arcuate shape. Ear 30 of portion 16A is inserted between ears 32 and 34 of portion 16B, and ear 30 of portion 16B is inserted between ears 32 and 34 of portion 16A, thereby encompassing column 12 between portions 16A and 16B. Fasteners 26, in the form of screws 26 extend from portions 16A and 16B to secure collar 16 to column 12. Fasteners 26 extend between ears 32 and 34 and engage a central portion of ear 30. It is also contemplated that portion 16A and/or 16B could be captivated to or be a part of tray 14. If only portion 16A is captivated to tray 14, then portion 16B would be coupled with the captivated portion 16B to constrain tray collar 16 to column 12.

Figure 3:
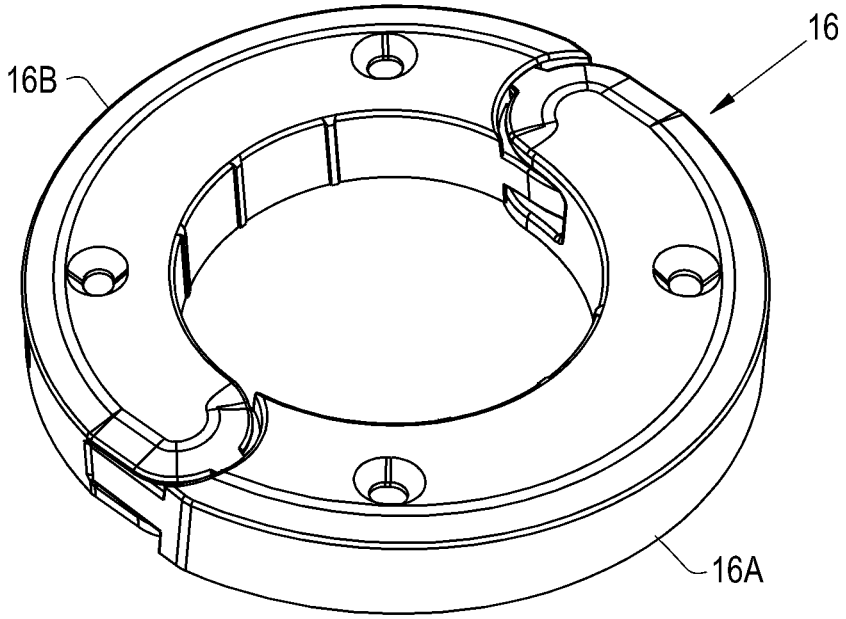
FIG. 3 is a bottom perspective view of the tray collar of FIGS. 1 and 2 assembled by itself apart from the tower.
Figure 4:
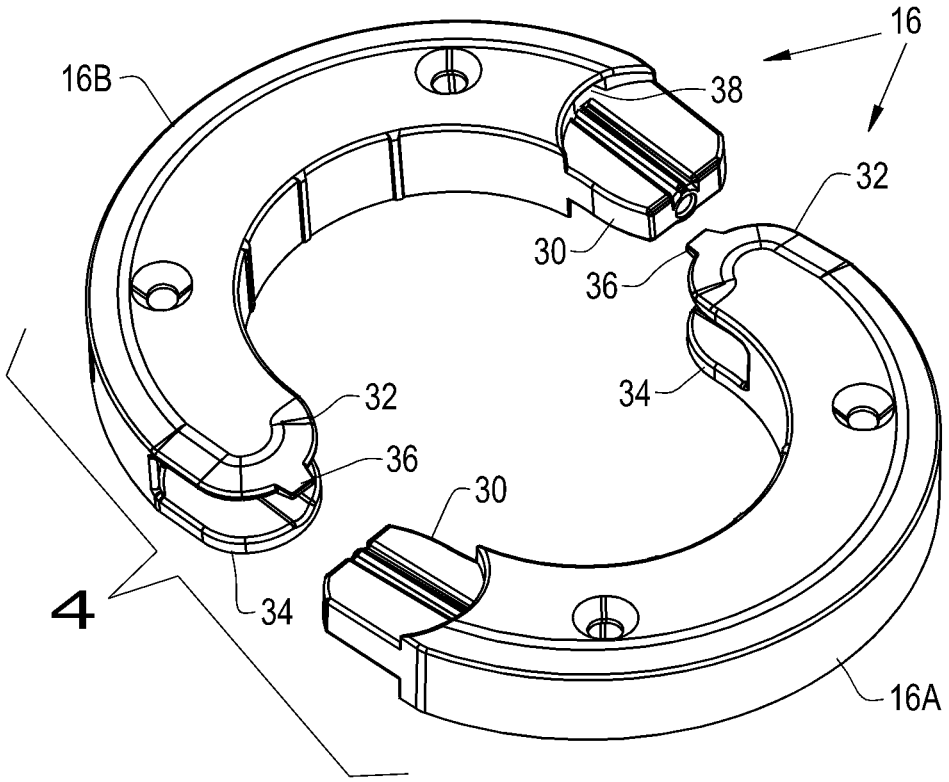
FIG. 4 is an exploded bottom perspective view of the tray collar of FIGS. 1-3.

Now, additionally referring to FIGS. 3 and 4, as particularly seen here portions 16A and 16B are identical and interact in a hermaphroditic manner to form collar 16. A tab 36 also interacts with a recess 38 to align portions 16A and 16B to each other.

Figure 5:
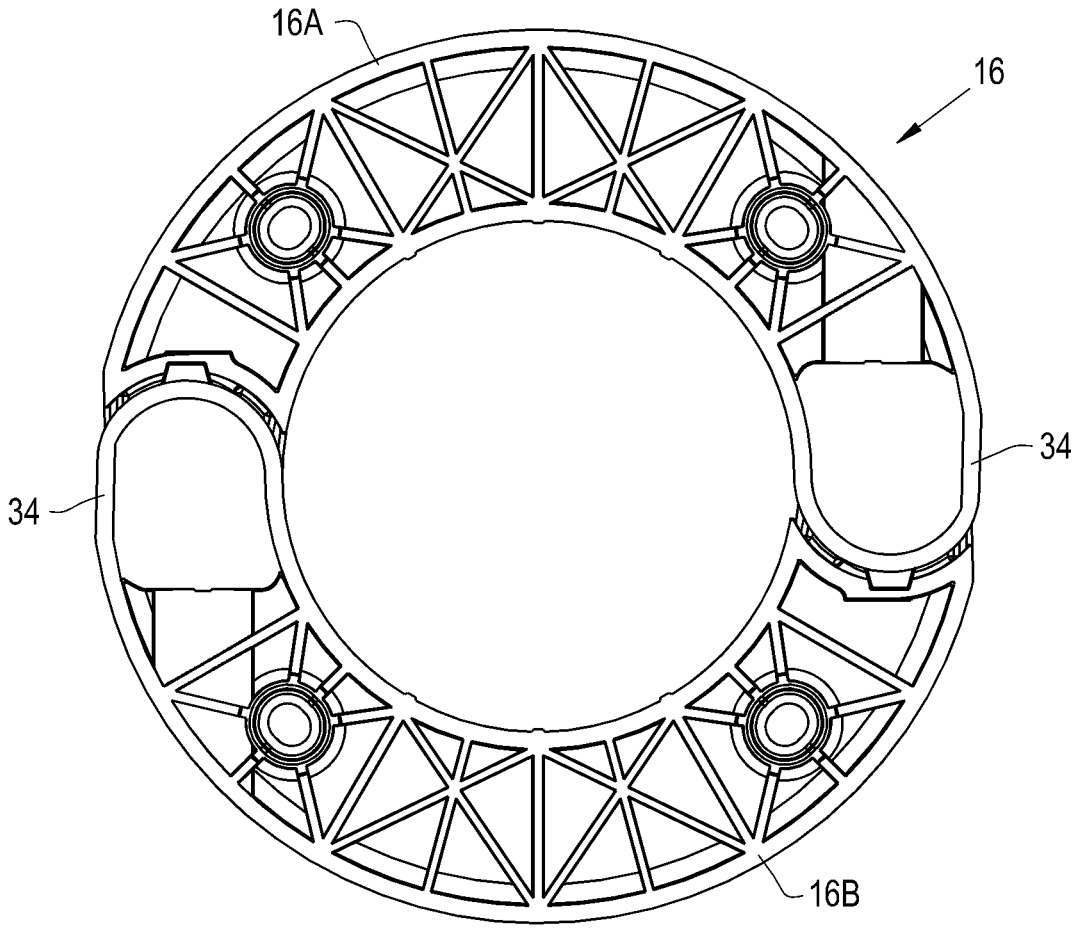
FIG. 5 is a top view of the assembled tray collar of FIG. 4.
Figure 6:
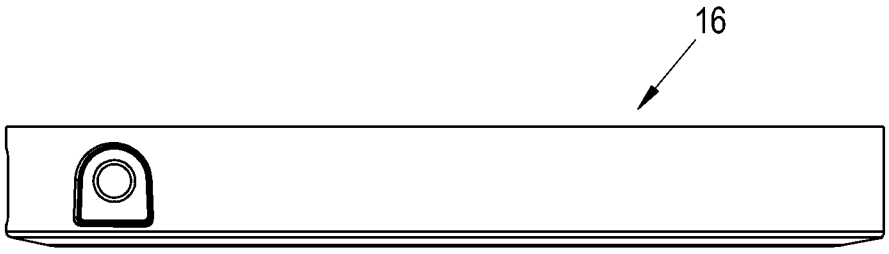
FIG. 6 is a side view of the assembled tray collar of FIGS. 4 and 5.
Figure 7:
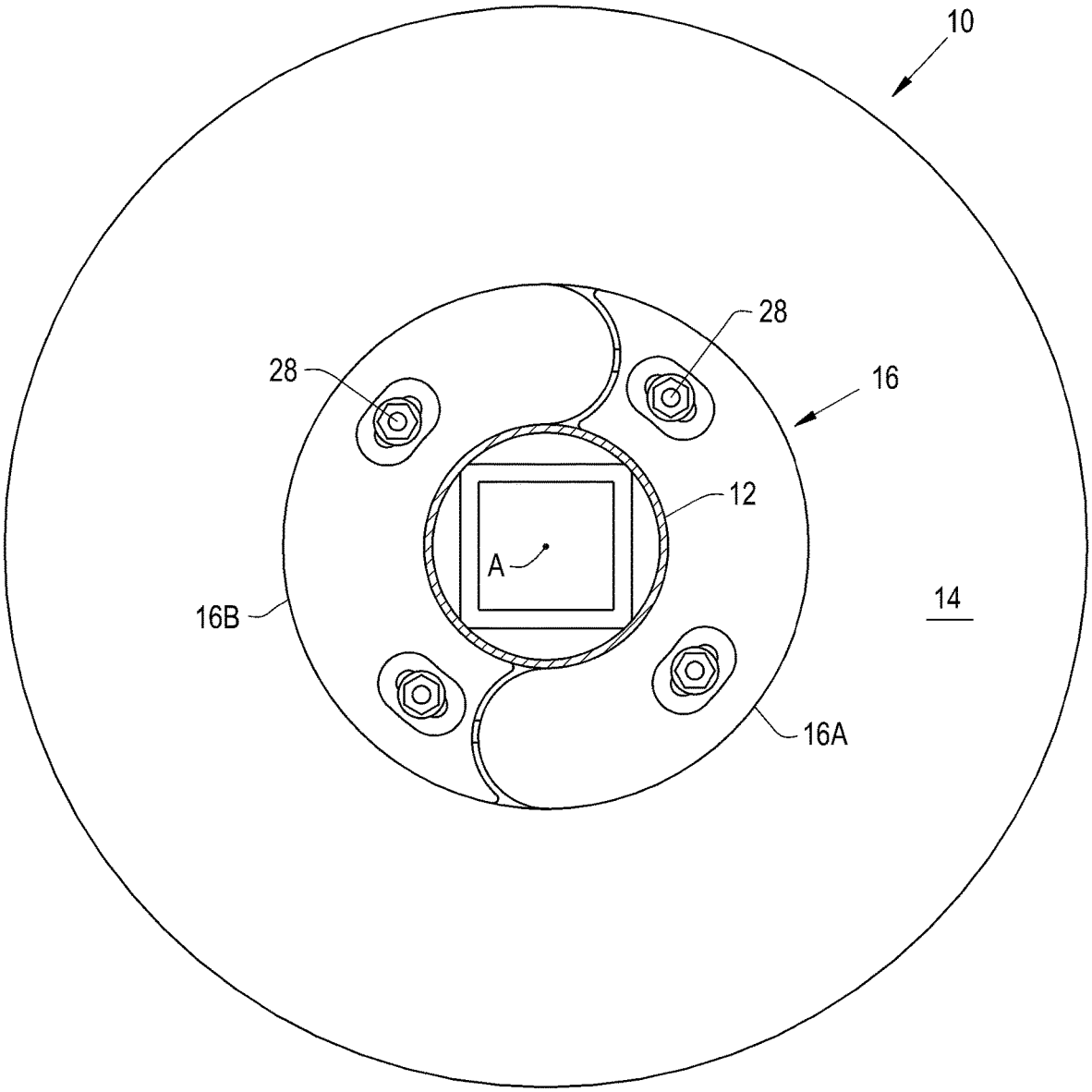
FIG. 7 is a cross sectional view of the tray collar of FIGS. 1-6 installed on the tower along sectional line 7-7.

Now, additionally referring to FIGS. 5, 6 and 7 there is shown a bottom and side view of collar 16 and a cross sectional view of tray system 10 taken along section line 7-7. FIG. 6 shows the hole into which fastener 26 is inserted, with the two fasteners 26 being used to draw portions 16A and 16B together against the outer surface of column 12. The symmetry of tray system 10 about axis A can be seen, which affords balance to tray system 10 allowing a symmetrical base 18 to be used for support.

Electrical wiring that supplies power to electrical outlets 20 and charging outlet 22 are contained within column 12. A power cord, not shown, exits from base 18 and is connected to power that is utilized by tray system 10. It is also contemplated that electrical power could alternatively be supplied through an opening in the top of column 12. Although tower tray system 10 has been illustrated as being configured to set on a horizontal surface, it is also contemplated that another embodiment of tower tray system 10 would extend from a floor to a ceiling. Further it is also contemplated that a tower tray system 10 could be suspended from a ceiling or another horizontal structure in a room.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A tray system, comprising:

a column;

a tray having an opening through which the column extends; and a tray collar constrained against the column, the tray being a part of or resting upon the tray collar, the tray collar having a plurality of portions that contact an outer surface of the column, the tray collar portions being separate from the tray, the tray collar that contacts the outer surface of the column has two portions including a first portion and a second portion, the tray collar portions being identical.

2. The tray system of claim 1, wherein the tray collar portions have an arcuate shape with a first ear on one end of the arcuate shape and second and third ears on an other end of the arcuate shape.

3. The tray system of claim 2, wherein the first ear of the first portion being inserted between the second and third ears of the second portion, and the first ear of the second portion being inserted between the second and third ears of the first portion, with the column being between the first portion and the second portion.

4. The tray system of claim 3, further comprising:

a first fastener; and a second fastener, the first fastener extending from the first portion to the second portion, and the second fastener extending from the second portion to the first portion.

5. The tray system of claim 4, wherein the first fastener extends between the second and third ears of the first portion into the first ear of the second portion.

6. The tray system of claim 5, wherein the second fastener extends between the second and third ears of the second portion into the first ear of the first portion.

7. A tray system, comprising:

a column;

a base coupled to an end of the column;

a tray having an opening through which the column extends; and a tray collar having a plurality of portions that are contactable to an outer surface of the column, the portions being constrained against the column, the tray resting upon the tray collar, the plurality of tray collar portions are two portions including a first portion and a second portion, wherein the two portions are identical.

8. The tray system of claim 7, wherein the tray collar portions have an arcuate shape with a first ear on one end of the arcuate shape and second and third ears on an other end of the arcuate shape.

9. The tray system of claim 8, wherein the first ear of the first portion is inserted between the second and third ears of the second portion, and the first ear of the second portion is inserted between the second and third ears of the first portion, with the column being between the first portion and the second portion.

10. The tray system of claim 9, further comprising:

a first fastener; and a second fastener, the first fastener extending from the first portion to the second portion, and the second fastener extending from the second portion to the first portion.

11. The tray system of claim 10, wherein the first fastener extends between the second and third ears of the first portion into the first ear of the second portion.

12. The tray system of claim 11, wherein the second fastener extends between the second and third ears of the second portion into the first ear of the first portion.

13. A method of supporting a tray, the method comprising the steps of:

extending a column through an opening in the tray;

contacting an outer surface of the column with a first portion and a second portion of a tray collar; and securing the first portion to the second portion against the outer surface of the column by way of drawing together the first portion and the second portion against the outer surface of the column, the drawing together step taking place by way of a first fastener extending from the first portion into the second portion and a second fastener extending from the second portion into the first portion.

14. The method of claim 13, wherein the two portions are identical each having an arcuate shape with a first ear on one end of the arcuate shape and second and third ears on an other end of the arcuate shape.

15. The method of claim 14, wherein the securing step includes inserting the first ear of the first portion between the second and third ears of the second portion, and inserting the first ear of the second portion between the second and third ears of the first portion, with the column being between the first portion and the second portion.

* * * * *